US005924258A

United States Patent [19]

Castaño

[11] Patent Number: 5,924,258

[45] Date of Patent: Jul. 20, 1999

[54] TRANSVERSE CLADDING SUPPORT APPARATUS AND METHOD

[75] Inventor: Francisco Castaño, Houston, Tex.

[73] Assignee: Geometrica, Inc., Houston, Tex.

[21] Appl. No.: 08/900,656

[22] Filed: Jul. 25, 1997

[51] Int. Cl.[6] ..... E04H 12/10; E04B 1/19

[52] U.S. Cl. ..... 52/653.1; 52/483.1; 52/650.1; 52/650.3; 52/652.1; 52/653.2; 52/655.1; 52/745.05; 52/746.1; 52/746.11; 52/761

[58] Field of Search ..... 52/653.1, 634, 52/637, 650.1, 652.1, 651.1, 719, 651.11, 656.1, 655.1, 653.2, 650.3, 483.1, 761, 745.05, 746.1, 746.11

[56] References Cited

U.S. PATENT DOCUMENTS

| | | | |
|---|---|---|---|
| 2,895,753 | 7/1959 | Fentiman . | |
| 2,916,109 | 12/1959 | Fentiman . | |
| 2,931,467 | 4/1960 | Fentiman . | |
| 2,964,147 | 12/1960 | Fentiman . | |
| 2,976,968 | 3/1961 | Fentiman . | |
| 3,079,681 | 3/1963 | Fentiman . | |
| 3,081,601 | 3/1963 | Fentiman . | |
| 3,152,819 | 10/1964 | Fentiman . | |
| 3,275,351 | 9/1966 | Fentiman . | |
| 3,309,121 | 3/1967 | Fentiman . | |
| 4,262,461 | 4/1981 | Johnson et al. | 52/653.1 X |
| 4,567,707 | 2/1986 | Herman | 52/586 |
| 4,583,359 | 4/1986 | Staeger | 52/653.1 X |
| 5,305,571 | 4/1994 | Trevino | 52/653.1 X |
| 5,671,579 | 9/1997 | Miranda Camino et al. | 52/653.1 X |

*Primary Examiner*—Christopher Kent
*Attorney, Agent, or Firm*—Haynes and Boone, L.L.P.; James R. Bell

[57] ABSTRACT

A cladding support system includes rounded tubular members having an arcuate face. The tubular members are connected to extend outwardly from hubs. A cladding support member is mounted on the arcuate face of the tubular members and extends transversely across the tubular members. The support member is substantially "U" shaped including a raised closed end and a pair of sides terminating at an open end. A flange extends outwardly from each side. Each flange is attached to the arcuate face of the tubular member. Cladding is attached to the raised closed end of the support member.

9 Claims, 9 Drawing Sheets

TRANSVERSE CLADDING SUPPORT APPARATUS AND METHOD

BACKGROUND

The disclosures herein relate generally to space frames and more particularly to a transverse cladding support apparatus and method for forming an unobstructed surface on the space frame for attaching cladding material thereto.

In space frame construction, a generally cylindrical hub includes a plurality of outwardly directed slots extending along the peripheral surface of the hub. The slots have opposed ribbed surfaces. Tubular frame members are flattened and crimped at their opposed ends. The crimped ends include elongated flat surfaces extending outwardly, or away from each other. The crimped ends are ribbed in a pattern which can be mated into engagement with the ribs in the hub slots. In this manner, each end of a tubular frame member may be slidably inserted into a respective hub slot and several tubular frame members may be connected at one end to a hub slot to form a spider, i.e., a hub having a plurality of tubes extending outwardly therefrom, each tube terminating at a free end.

The free end of each tube can be similarly connected to another hub. Thus, a framework of interconnected spiders formed of tubes and hubs can be joined to form a preassembled or modular section of a flat roof, a domed roof, a wall, etc., to be joined with other sections to eventually form a complete structure. The structure, once completed is then covered with a selected cladding which is attached to the structural framework by means of an interfacing cladding support system.

The cladding may be fabric, corrugated steel plates, glass, and other selected materials, and may include combinations of these materials for architectural design purposes. For example, a domed roof may be clad with steel and may include a pattern of glass panels in a portion of the roof which has an aesthetic effect when viewed from the interior of the structure.

It is important that the interfacing cladding support system establish a substantially unobstructed surface for supporting the cladding material so as to provide a smooth cladding surface. As such, the cladding support system is superimposed on the framework to avoid protruding elements of the framework. For example, washers are mounted on opposite ends of the hubs to close the ends of the hub slots and retain the crimped ends of the tubular frame members. These washers are retained by bolts which have ends protruding above the hub and washer. In addition, the support members have uneven surfaces, e.g., the flattened ends of the tubular support members extend above the arcuate surfaces of the tubular support members.

To accommodate these uneven surfaces and protrusions, cladding support systems have been provided which suspend cladding support members in raised relationship spaced from the space frame elements. Such cladding support systems are expensive and difficult to install because of the number of parts required. Also, the spatial relationship between the space frame and the cladding support members is often flexible and as such is not sufficiently rigid for providing satisfactory support for the cladding material.

A cladding support system has been developed which includes support elements rigidly seated directly on the space frame elements and which also avoids protrusions and uneven surfaces of the frame members as to provide an unobstructed surface on the space frame for attaching cladding material thereto. However, these support elements have a contoured contact surface specifically provided to seat axially along the tubular frame members, terminate at each hub and are not provided to span transversely from one tubular frame member to another.

Therefore, what is needed is an apparatus and method of providing a cladding support system which includes support elements rigidly seated directly on, and spanning transversely across multiple space frame elements so as to provide an unobstructed and even surface on the space frame for attaching cladding material thereto.

SUMMARY

One embodiment, accordingly, provides an apparatus and a method for seating cladding support system elements directly on and spanning transversely across multiple space frame members for forming an unobstructed and even surface on the space frame for attaching a cladding material thereto. To this end, a cladding support system includes a framework having elongated members connected to hubs and extending radially outwardly therefrom. A cladding support member is mounted directly on the elongated members and extends transversely thereacross. The support member is substantially "U" shaped including a closed end and a pair of sides terminating at an open end. A flange extends outwardly from each side adjacent the open end. Each flange is attached to the elongated members so that the closed end is in a raised position relative to the elongated members.

A principal advantage of this embodiment is that the flanges of the cladding support member seat directly on and are attached to the tubular members of the space frame, and span transversely across the tubular members. The closed end of the "U" shaped support member is at a level which avoids nut and bolt protrusions from the hub and is smooth to provide an unobstructed and even surface for attaching the cladding material. The result is a rigid smooth interface between the space frame and the cladding material.

DETAILED DESCRIPTION OF THE PREFERRED EMBODIMENT

Figure 1:
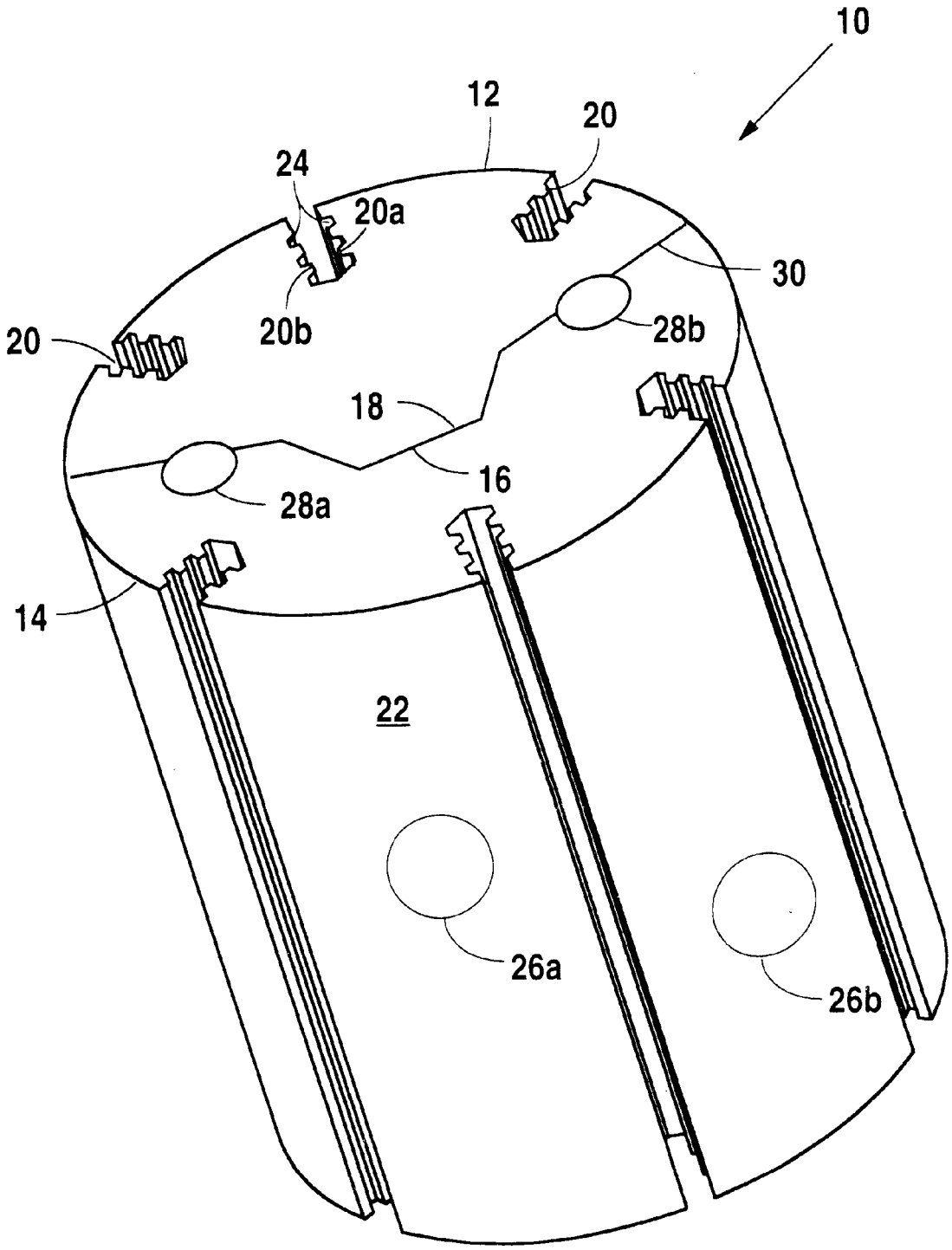
FIG. 1 is an isometric view illustrating an embodiment of a split hub disclosed herein.

Referring now to the drawings, FIG. 1 illustrates a split separable joint comprising a substantially cylindrical hub, generally designated 10, including a first hub portion 12 and a second hub portion 14. A keyed surface 16 on portion 12 is mated to abut a keyed surface 18 on portion 14. This insures that hub portions 12 and 14 will nest together as a unit. A plurality of radially directed slots 20 are formed to extend axially along a peripheral surface 22 of hub 10. Slots 20 are keyed with a plurality of ribs 24 on a pair of opposed slot sides 20*a* and 20*b* which face inwardly or toward each other. It should be noted that hub 10 may be of a shape other than cylindrical. Slots 20 may also be outwardly directed without being radially directed.

Figure 2:
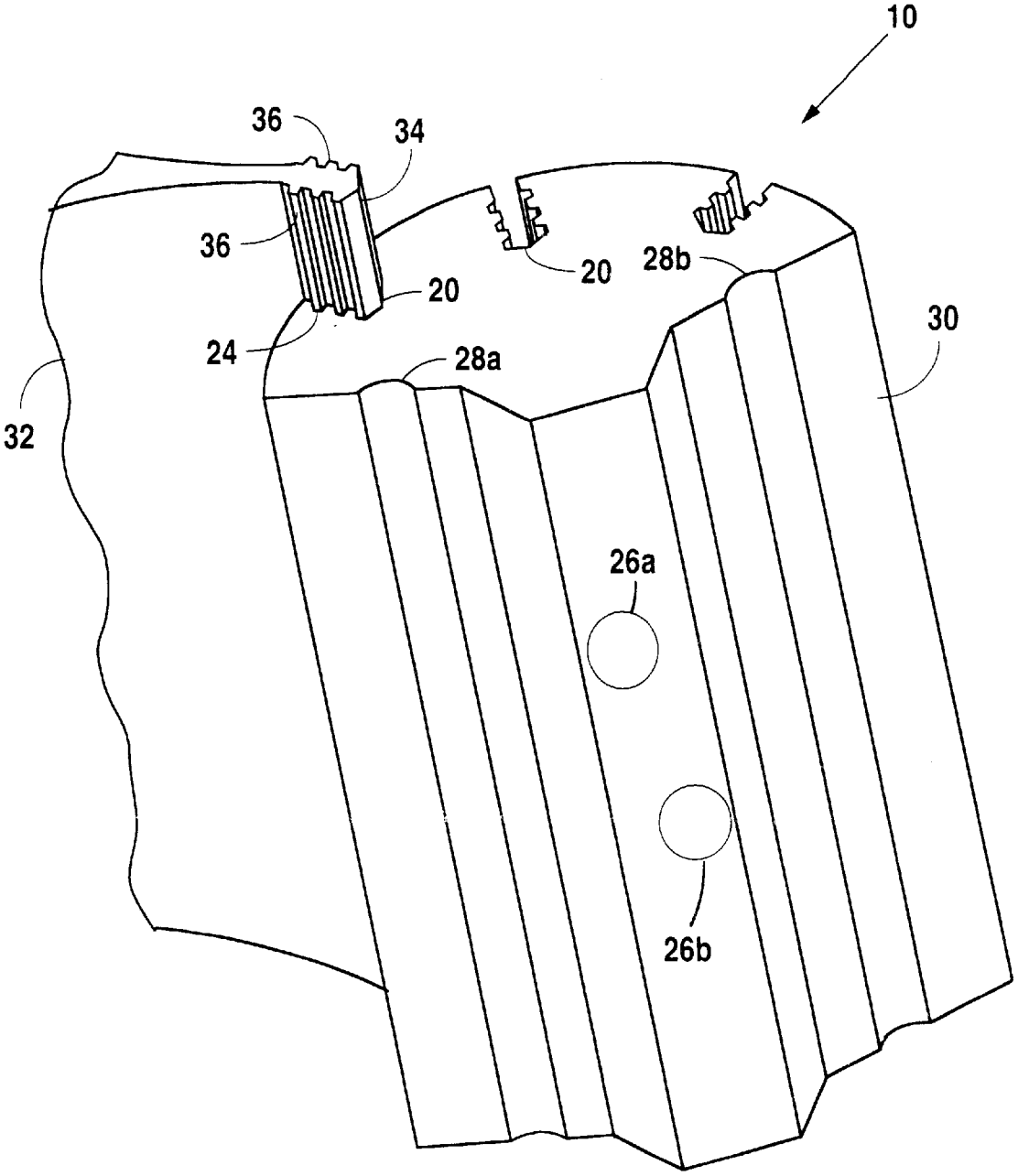
FIG. 2 is an isometric view illustrating an embodiment of a portion of a split hub having a tubular support member connected therewith.
Figure 3:
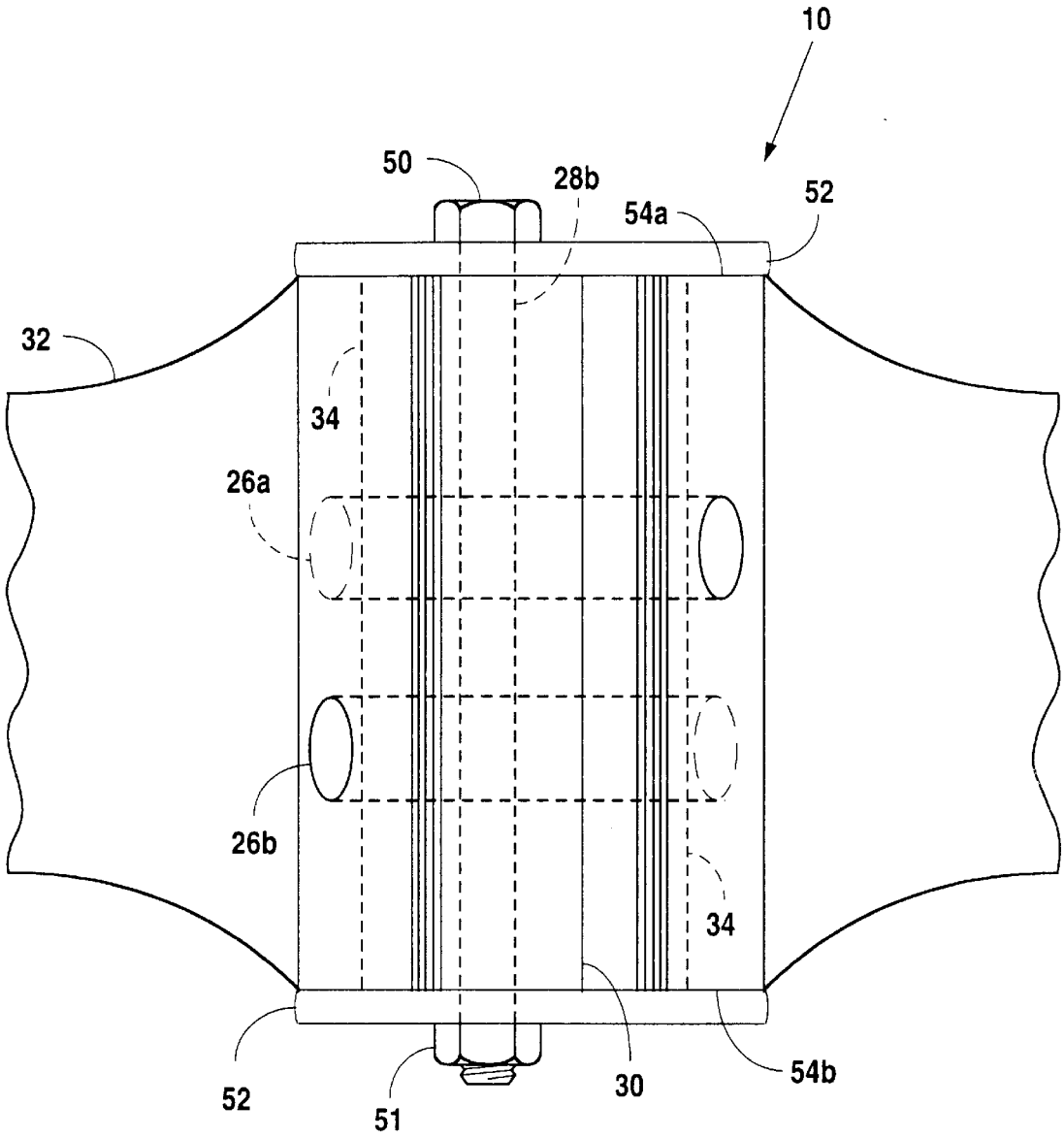
FIG. 3 is a side view illustrating an embodiment of the split hub fully assembled including end plates for retaining tubular support members in their respective slots.

Hub 10 includes a first pair of bores 26*a*, 26*b* formed diametrically therethrough and a second pair of bores 28*a*, 28*b* formed axially therethrough. FIGS. 1, 2 and 3 illustrate that axial bores 28*a* and 28*b* are spaced apart from each other along an interface 30 between keyed surfaces 16 and 18. Interface 30 axially splits hub 10 into portions 12 and 14. Also, it can be seen that a portion of each bore 28*a*, 28*b* is formed in hub portion 12 and a complimentary portion of each bore 28*a*, 28*b* is formed in mating hub portion 14. FIGS. 1–6 illustrate that bores 26*a*, 26*b* are axially spaced apart and are also radially offset so that the axes of bores 26*a*, 26*b* criss-cross within hub 10 as viewed in FIGS. 4–6. Bores 26*a*, 26*b* do not need to be radially offset, but may be axially spaced and aligned, i.e. one directly above or below the other.

Slots 20 are provided for receiving and retaining a plurality of tubular structural members 32, FIGS. 2 and 3 therein. Members 32 may be slidably retained in slots 20. Opposite keyed ends 34, FIG. 2, of members 32 are flattened and have a plurality of outwardly facing ribs 36 crimped into ends 34 for mating engagement with inwardly facing ribs 24 of slots 20.

Figure 6:
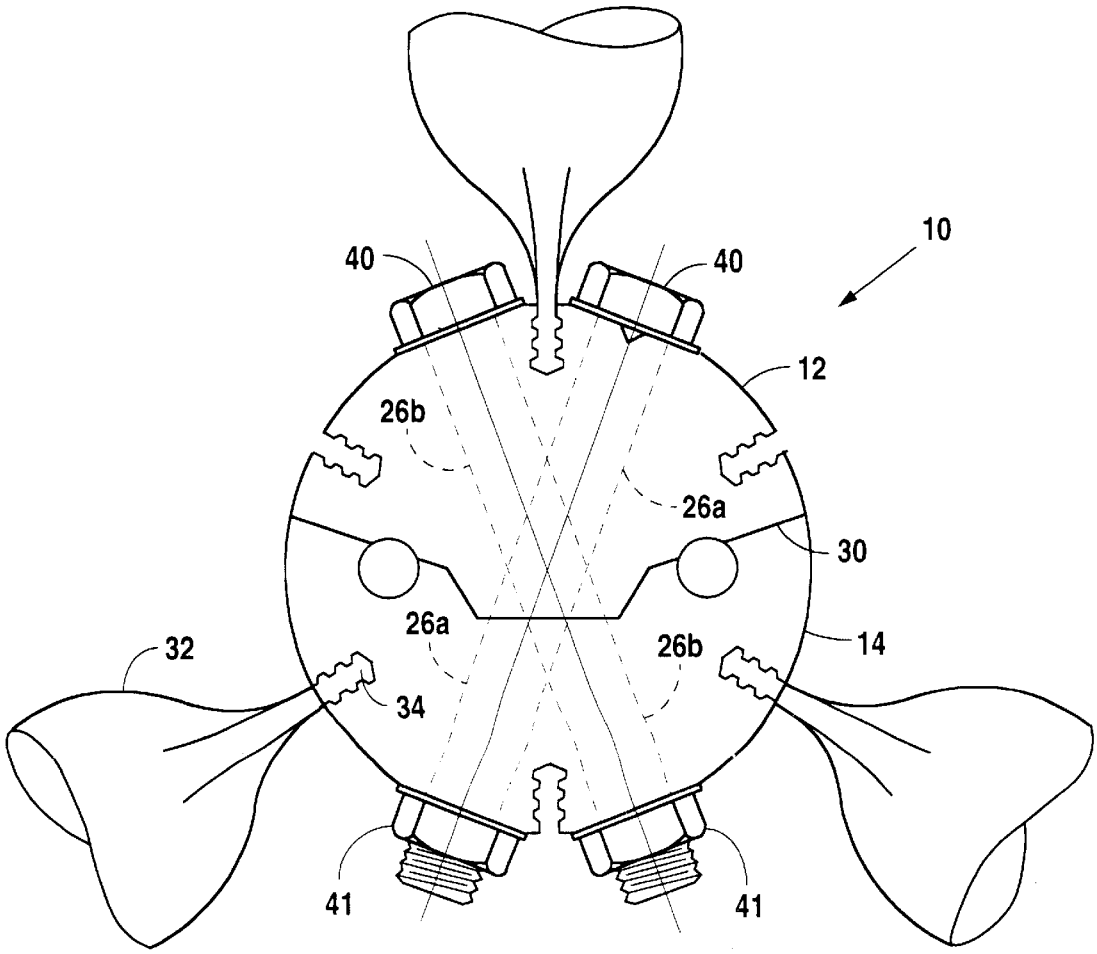
FIG. 6 is a plan view illustrating an embodiment of a split hub assembled and connected by bolts and having tubular support members engaged therewith.

Means such as bolts 40 and nuts 41, FIG. 6, are provided for fastening and retaining first hub portion 12 and second hub portion 14 in unitary keyed engagement. Bolts 40 extend through diametrically extending bores 26*a*, 26*b*. It can be seen from FIGS. 1-6 that each bore 26*a* and 26*b* is partially formed in each hub portion 12, 14 so that when hub portions 12, 14 are mated to form interface 30, the respective portions of bores 26*a*, 26*b* are aligned to receive bolts 40. The criss-cross and axially displaced pattern of bolts 40 adds stability to the unitary structure of hub 10.

In order to retain tubular structural members 32 in hub 10, a pair of bolts 50, and nuts 51, only one of which is shown in FIG. 3, are provided for extending through axially extending bores 28*a*, 28*b*. A pair of end plates or washers 52 are maintained in abutment with opposed ends 54*a*, 54*b* of hub 10 by bolts 50 and nuts 51. This captures ends 34 of structural members 32 within slots 20.

Figure 4:
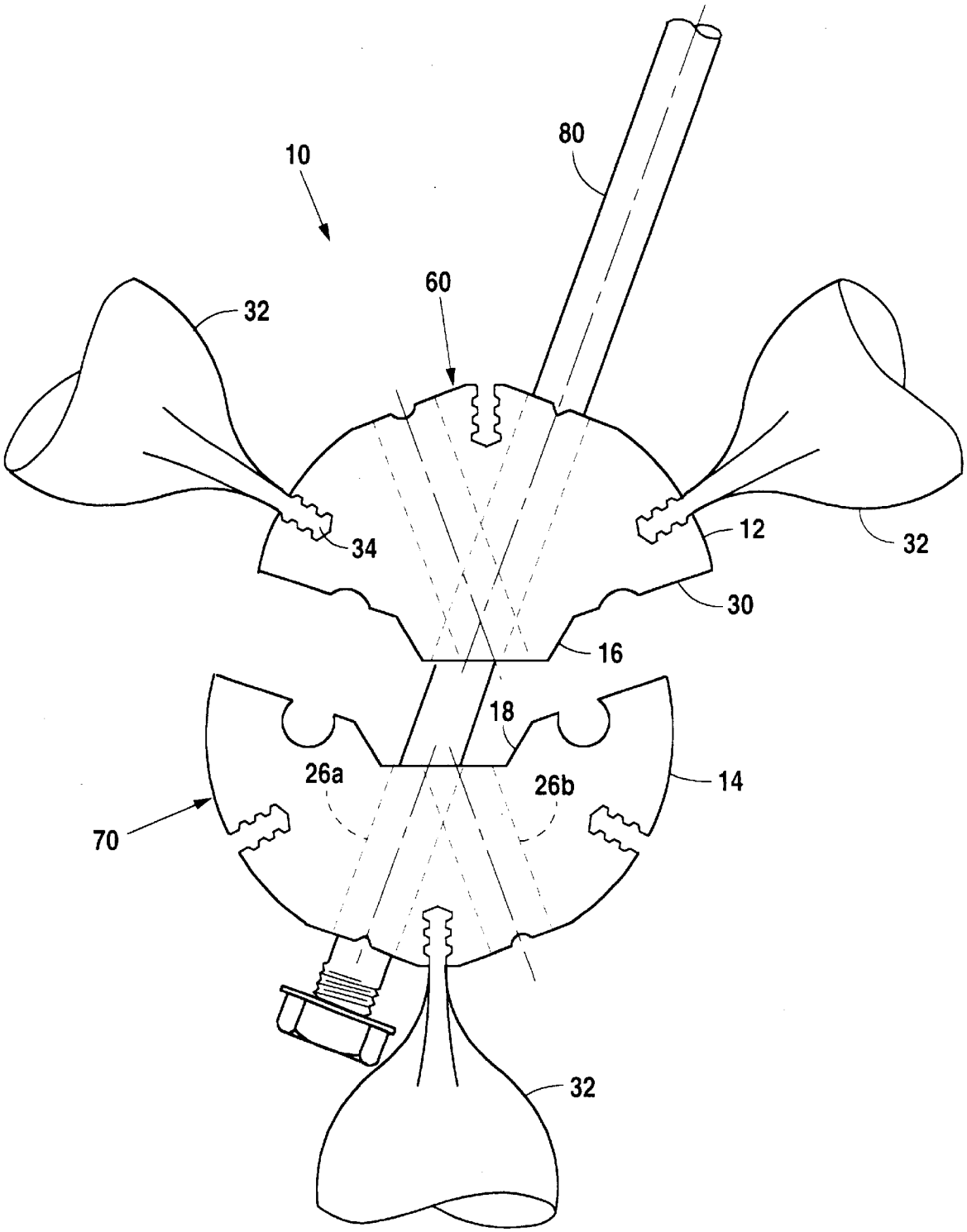
FIG. 4 is a plan view illustrating an embodiment of separated portions of the split hub having an alignment member and tubular support members engaged therewith.
Figure 5:
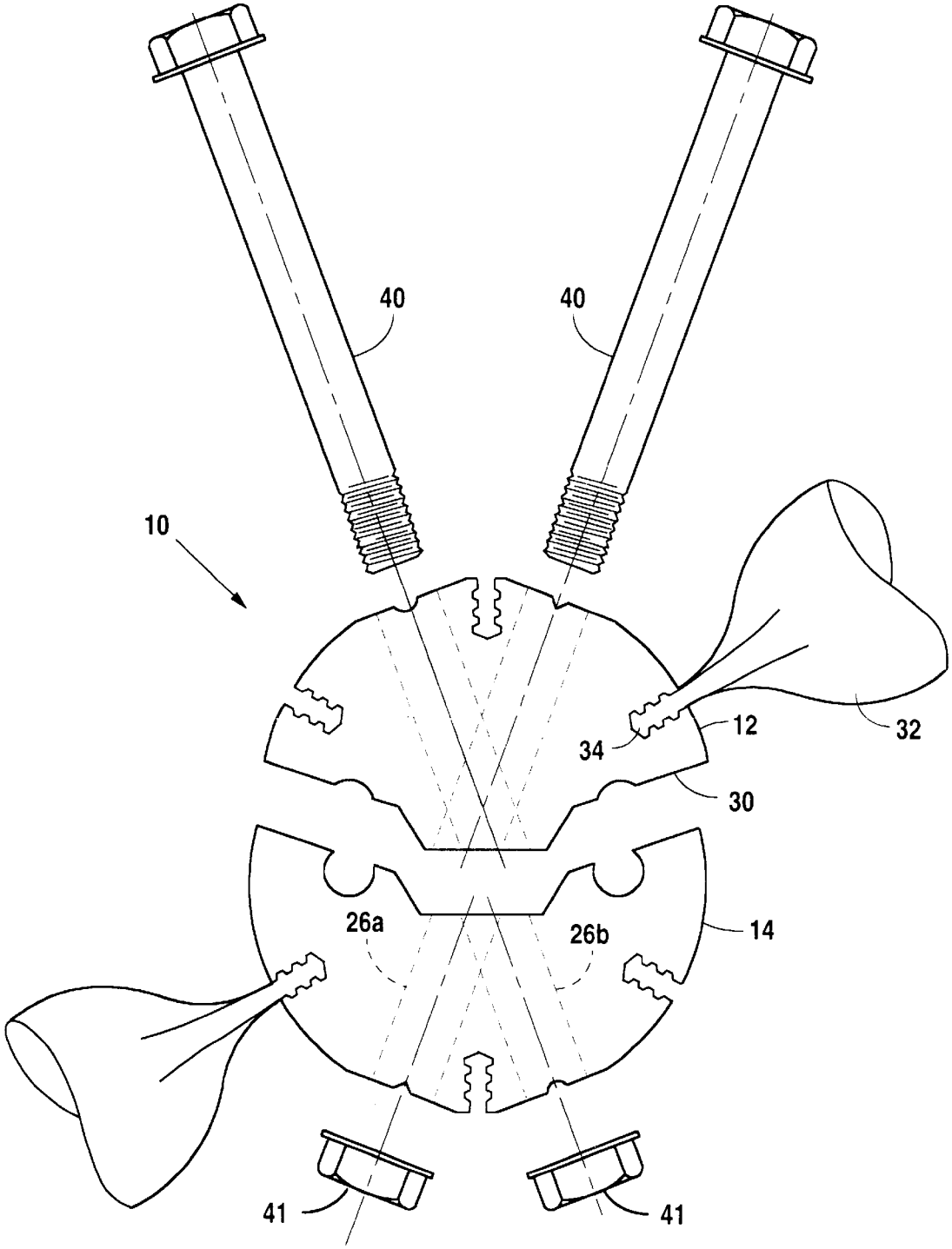
FIG. 5 is a plan view illustrating an embodiment of separated portions of the split hub having tubular support members engaged therewith and attachment bolts positioned for engagement.

A first section of a frame 60, FIG. 4, includes at least one hub portion 12 connected with at least one structural member 32. A second section of a frame 70, also includes at least one hub portion 14 connected with at least one structural member 32. When it is desired to join the first and second frame sections 60, 70, respectively, hub portion 12 and hub portion 14 may be aligned for mating engagement by using an alignment device such as a steel rod 80, or the like extended through bore 26*a*, for example. The sections 60, 70 can then be drawn together along rod 80 until faces 16 and 18 mate to form interface 30. One of the bolts 40 and nuts 41, illustrated in FIGS. 5 and 6, can then be inserted into bore 26*b* and fastened to retain hub portions 12 and 14 together. Rod 80 can then be removed and another bolt 40 and nut 41 can be inserted to replace rod 80 in bore 26*a* and fastened to stabilize hub portion 12 and 14 together as illustrated in FIG. 6. End plates 52, FIG. 3, can then be retained in place by bolts 50 and nuts 51 to retain the structural members 32 connected to hub 10.

When frame sections 60 and 70, FIG. 6, are joined and a space frame is completed, cladding can be added. In order to accomplish this, a cladding support system is mounted on the space frame to provide an unobstructed surface to which a selected cladding is attached. As such, the surface must compensate for high and low points along the framework caused by the varying shape of the tubular structural members 32, FIG. 3, having flattened ends 34 and also caused by the protruding bolts 50 of hubs 10.

Figure 7:
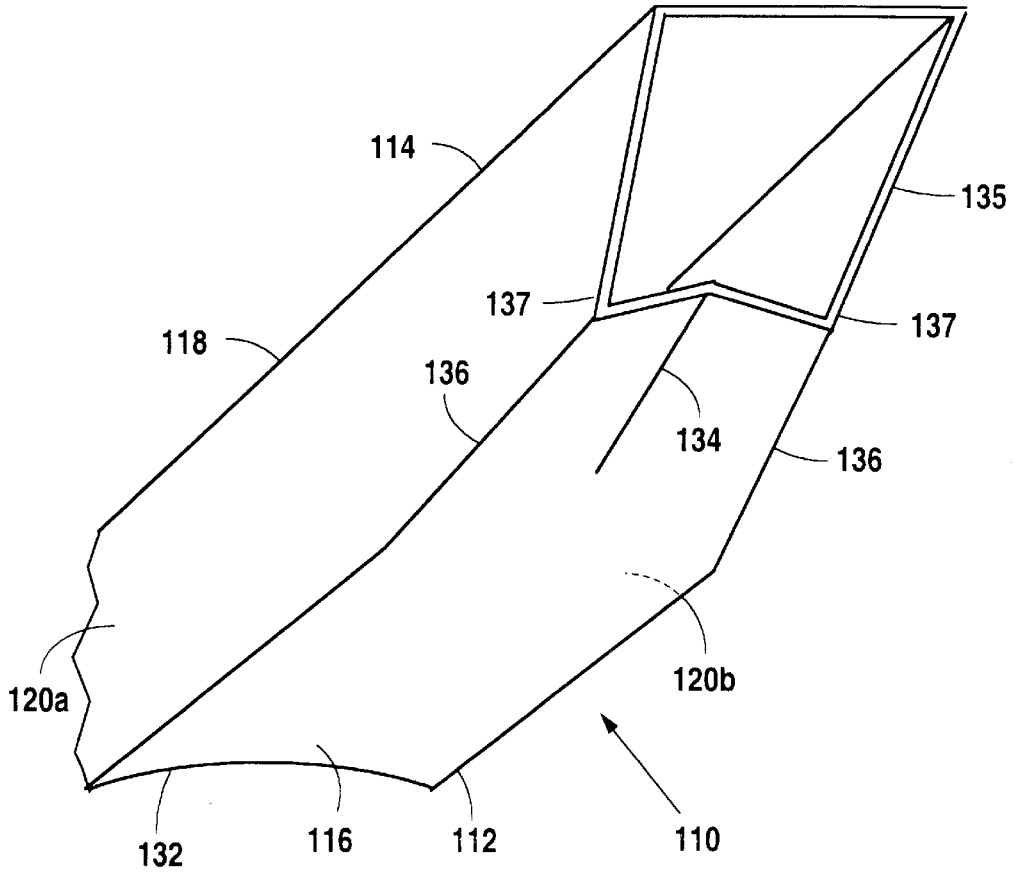
FIG. 7 is an isometric view partially illustrating an embodiment of a contoured cladding support member.

Referring to FIG. 7, a cladding support element is generally designated 110 and includes an elongated span 112 and opposite end portions 114, only one of which is shown. Support element 110 is preferably a section of square or rectangular steel tubing having a first surface 116, a second surface 118 and a pair of opposed side surfaces 120*a* and 120*b*. First surface 116 is contoured to rest directly on tubular support member 32, which has a generally arcuate peripheral surface 23, see FIG. 9. However, tubular member 32 includes flattened end 34 as stated above. As such, the profile of tubular support member 32 is changed at the ends 34 and is raised relative to surface 23. Furthermore, the flattened ends 34 are non-circular, see FIGS. 8 and 10.

As a result, first surface 116 requires a variable contour so as to be able to rest directly on tubular member 32 along span 112 and end portions 114. In order to accomplish this, the span portion 112 of surface 116 of support element 110 has a curvature 132, FIG. 7, which engages peripheral surface 23. Curvature 132 transitions to a "V" shaped groove 134 at end portion 114 so as to engage raised flattened ends 34 of support member 32. In addition, sides 120*a* and 120*b* and surface 116 include a tapered portion 136 at end portion 114 to accommodate raised ends 34 of support member 32. See FIG. 9. Also, sides 120*a*, 120*b* have an angular terminal end 135, FIG. 7, extending from first surface 116 to a substantially flat second surface 118. In this manner, second surface 118 overhangs first surface 116, FIG. 8. Furthermore, sides 120*a*, 120*b* are tapered inwardly at 137, FIG. 7, toward each other adjacent end portion 114 to accommodate the crimped end 34 of support member 32.

Figure 8:
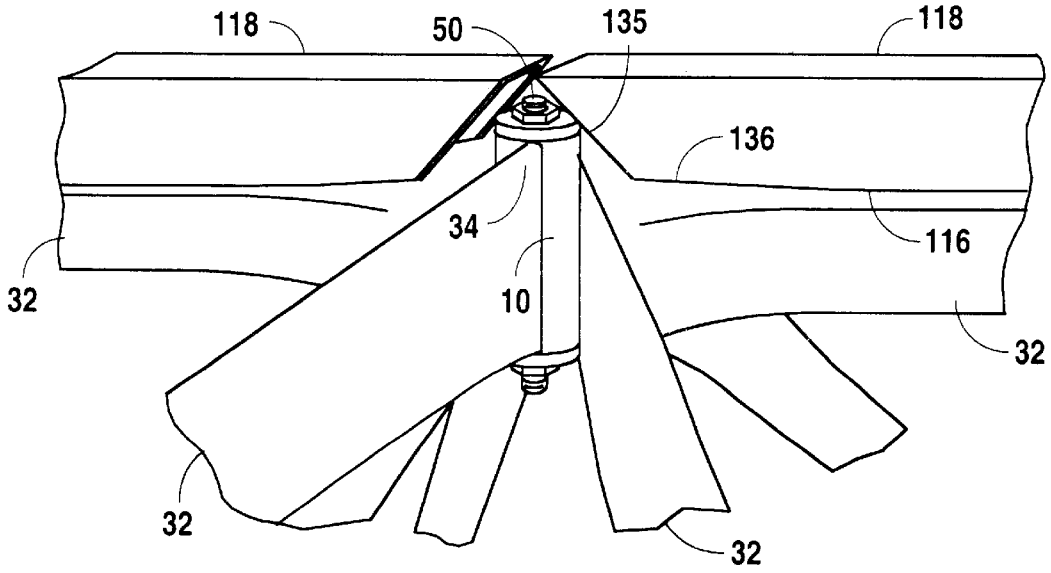
FIG. 8 is an isometric view partially illustrating tubular support members connected to a hub and contoured cladding support members mounted directly on the tubular members.
Figure 9:
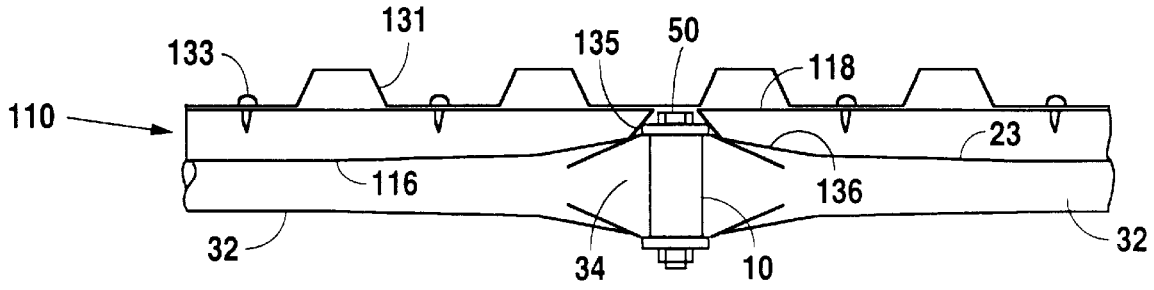
FIG. 9 is a side view partially illustrating tubular support members connected to a hub, contoured cladding support members mounted directly on the tubular members and cladding material attached to the cladding support members.
Figure 10:
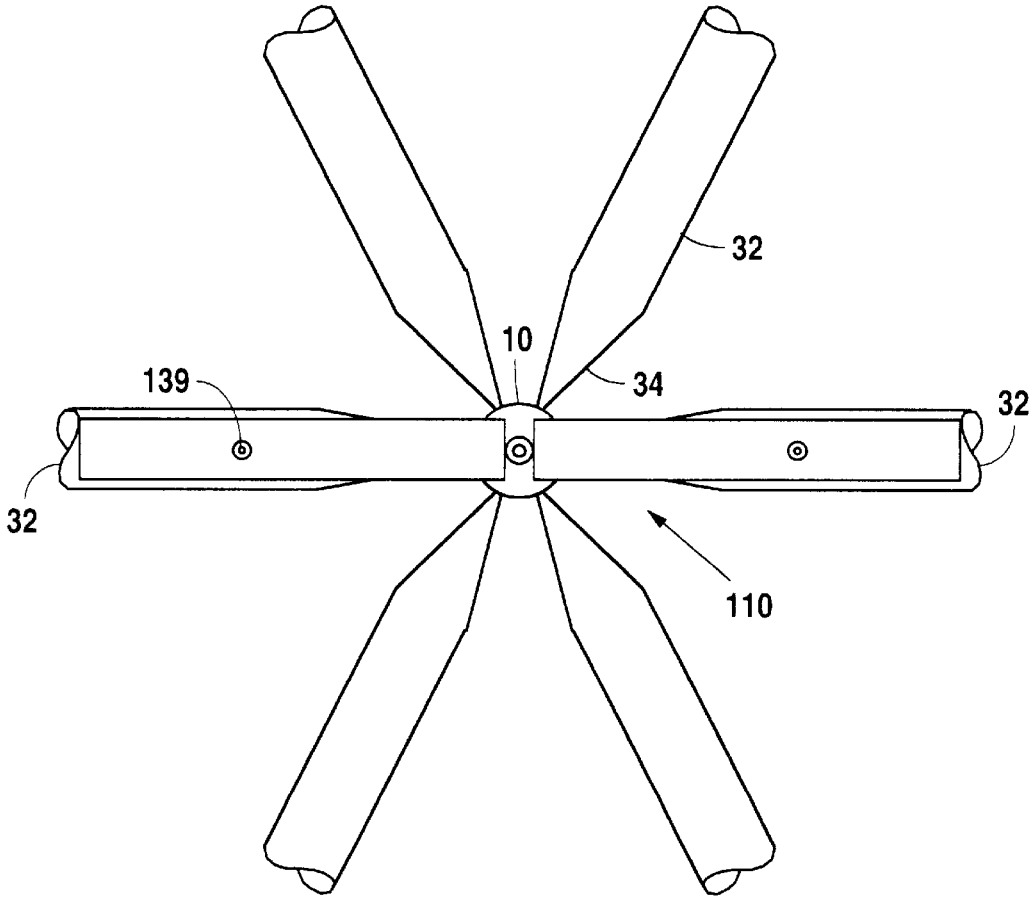
FIG. 10 is a top view illustrating tubular support members connected to a hub and contoured cladding support members mounted on the tubular members.

In this manner, as illustrated in FIG. 8, an unobstructed cladding support system is provided by attaching a pattern of cladding support elements 110 directly to tubular support members 32 by appropriate fasteners 139, FIG. 10. The contoured lower or first surface 116 accommodates the variations in support member 32. The flat or upper surface 118 provides an interface free of obstructions for supporting, for example, a corrugated steel cladding material, 131, FIG. 9, which is mounted thereon by appropriate fasteners 133. The angular, terminal end 135 accommodates the hub 10, and the overhanging second surface 118 at the angular, terminal end 135 also covers the bolt 50, protruding from hub 10.

Figure 11:
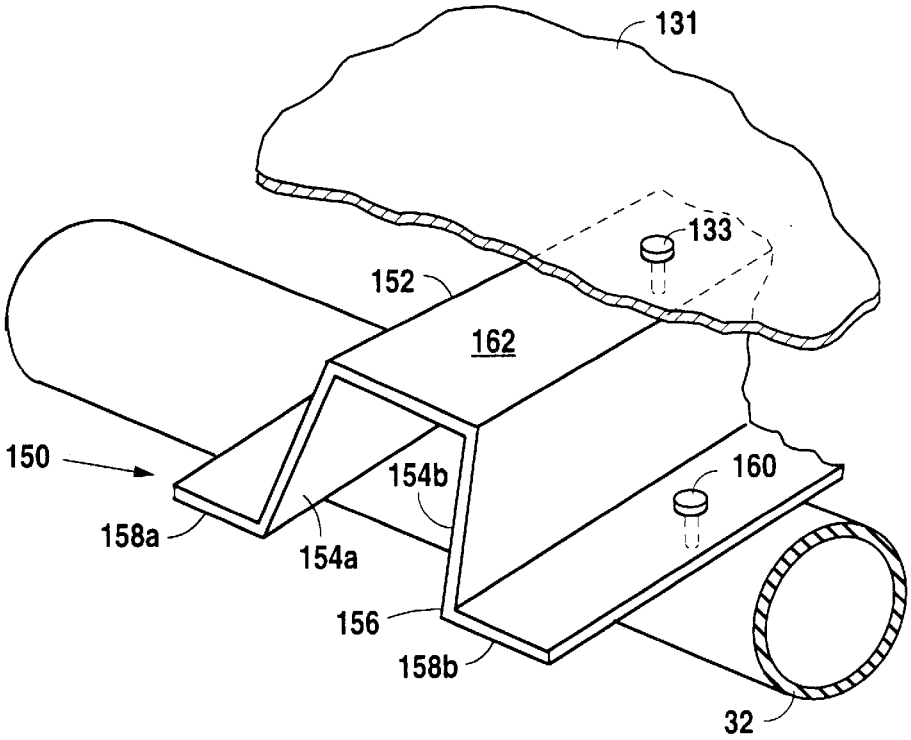
FIG. 11 is an isometric view partially illustrating an embodiment of a "U" shaped cladding support member.

In addition to the contoured cladding support elements 110, it may, in some instances, be necessary or desirable to provide a cladding support member or element which extends transversely across several tubular structural members 32. Referring to FIG. 11, a transverse cladding support member is designated 150 and is generally "U" shaped including a closed end 152 and a pair of opposed sides 154*a*, 154*b* terminating at an open end 156. A pair of flanges 158*a*, 158*b* extend outwardly in opposite directions from each side 154*a*, 154*b* , respectively, adjacent the open end 156.

Figure 12:
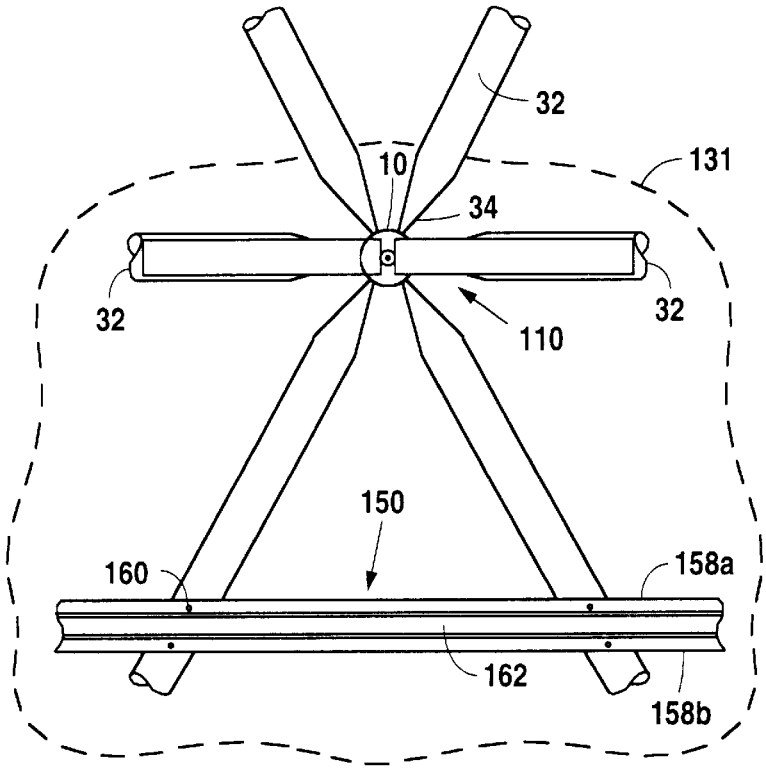
FIG. 12 is an isometric view illustrating an embodiment of a partial framework having a cladding material mounted thereon via a cladding support interface.

Member 150, FIGS. 11 and 12, is mounted directly on the elongated tubular structural members 32 and extends and spans transversely thereacross. By attaching the flanges 158*a*, 158*b* directly to members 32, by a suitable attachment means 160, closed end 152 is supported in a raised position relative to the tubular structural members 32. Thus, the flanges 158*a*, 158*b* provide a first surface for mounting transverse cladding support member 150 on the tubular structural members 32 and a surface 162 of closed end 152, provides a substantially smooth, flat raised surface for attaching cladding material 131 thereto by a suitable attachment means. In this manner, surface 118 of contoured cladding support member 110 is spaced apart from and adjacent to surface 162 of transverse cladding support member 150. Thus, surfaces 118 and 162 cooperatively provide an interface connected directly to space frame support members 32 for attaching cladding material 131 by fasteners 133.

As it can be seen, the principal advantages of these embodiments are that the flanges of the cladding support member seat directly on and are attached to the tubular members of the space frame, and span transversely across the tubular members. The closed end of the "U" shaped member is at a raised level which avoids nut and bolt protrusions from the hub and is smooth to provide an unobstructed and even surface for attaching the cladding material. The result is a rigid, smooth interface between the space frame and the cladding material.

Although illustrative embodiments have been described, a wide range of modifications, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A cladding support system in combination with a cladding material, comprising:

a framework including tubular members having an arcuate face and opposite ends inserted in cylindrical hubs, the hubs having a fastener protruding above the arcuate face;

cladding support elements having terminal ends and extending axially along adjacent ones of the tubular element, each cladding support member having an arcuate first surface including a groove at each terminal end, the first surface being engaged with an arcuate surface of an adjacent tubular member, the cladding support elements each having a raised flat second surface;

cladding support members mounted directly on others of the tubular members and extending transversely thereacross, the support members being substantially "U" shaped including a closed end and a pair of sides terminating at an open end;

a flange extending outwardly from each side adjacent the open end, each flange being attached to the tubular members so that the closed end is in a raised position relative to the tubular members; and a cladding material attached to the raised closed end of the cladding support members and to the raised flat second surface of the cladding support elements.

2. The cladding support system as defined in claim 1 wherein each terminal end is angular.

3. The cladding support system as defined in claim 2 wherein the groove is a "V" shaped groove.

4. The cladding support system as defined in claim 1 wherein the flanges extend in opposite directions from each other forming a mounting surface for mounting on the tubular members.

5. The cladding support system as defined in claim 4 wherein the raised flat second surface overhangs the fastener.

6. A cladding support system in combination with a cladding material, comprising:

a framework including tubular members having an arcuate face, and opposite ends, the tubular members being connected to hubs and extending outwardly from the hubs;

cladding support elements having terminal ends and extending axially along adjacent ones of the tubular members, each cladding support element having a first arcuate surface including a "V" shaped groove at each terminal end, the first surface being engaged with an arcuate surface of an adjacent tubular member, the cladding support elements each having a raised flat second surface;

cladding support members mounted on the arcuate face of others of the tubular members and extending transversely thereacross, the support members being substantially "U" shaped including a raised closed end and a pair of sides terminating at an open end;

a flange extending outwardly from each side, each flange being attached to the arcuate face of the tubular members; and a cladding material attached to the raised closed end of the cladding support members and to the raised flat second surface of the cladding support elements.

7. A method of mounting cladding and a cladding support system on a framework including tubular support members having an arcuate face and having flattened ends connected in hub members, the hub members having retaining bolts protruding therefrom, and the support members extending radially outwardly from the hub members, comprising the steps of:

forming cladding support elements with an elongated span and opposite end portions;

forming an arcuate first surface along the span;

forming a flat second surface in raised relationship to and overhanging the first surface;

forming terminal ends of the support elements to extend angularly from the first surface to the overhanging second surface;

forming a groove in the first surface adjacent each terminal end;

forming a taper on the first surface adjacent each groove;

seating the support elements on adjacent ones of the tubular support members so that the arcuate first surface of the support elements engages the arcuate face of the support members, so that the flat second surface is positioned above the protruding bolts and overhangs the hub member, and so that the grooves and tapers engage the support members adjacent the opposite end portions;

securing the support elements on the tubular support members;

forming cladding support members in substantially a "U" shape including a raised closed end and a pair of sides terminating at an open end;

forming a flange extending outwardly from each side so that the flanges extend in opposite directions;

forming the closed end with a surface spaced from the flanges;

mounting the cladding support members transversely across the others of the tubular support members;

attaching the flanges to the tubular support members; and attaching a cladding material to the cladding support members and the cladding support elements so that the cladding material is supported in raised relationship to the tubular members.

8. A cladding support system in combination with a cladding material, comprising:

a hub including a first portion and a second portion;

a keyed surface on the first portion and a mating keyed surface on the second portion;

a keyed slot formed in a peripheral surface of each portion of the hub;

means for retaining the first and second hub portions in unitary keyed engagement;

rounded tubular members having an arcuate face and flattened opposite ends, the ends being inserted into the keyed slots of each portion of the hub;

cladding support elements extending axially along the tubular members, the support elements having an elongated span and opposite end portions each including a terminal end, the span having an arcuate first surface in seated engagement with the arcuate face of adjacent ones of the tubular members and a raised second flat surface, the end portions of the support elements each having a tapered surface coextensive with and angularly disposed relative to the arcuate surface, the tapered surface including a "V" shaped groove at each terminal end of the support elements for receiving the flattened ends of the tubular members;

cladding support members mounted directly on others of the tubular members and extending transversely thereacross, the support members being substantially "U" shaped including a raised closed end and a pair of sides terminating at an open end;

a flange extending outwardly from each side adjacent the open end, each flange being attached to the tubular members so that the closed end is in a raised position relative to the tubular members; and a cladding material attached to the cladding support elements and the cladding support members so that the cladding material is supported in raised relationship to the rounded tubular members.

9. A cladding support system in combination with a cladding material, comprising:

a hub including a first portion and a second portion;

a keyed surface on the first portion and a mating keyed surface on the second portion;

means extending diametrically through aligned bores in each hub portion for engaging the keyed surfaces and retaining the hub portions in unitary engagement;

a plurality of structural members attached to the hub and extending radially outwardly therefrom;

cladding support elements extending axially along adjacent ones of the structural members, each cladding support element having a first surface engaged with each structural member and a raised second surface;

cladding support members mounted directly on others of the structural members and extending transversely thereacross, the cladding support members being substantially "U" shaped including a raised closed end and a pair of sides terminating at an open end;

a flange extending outwardly from each side adjacent the open end, each flange being attached to the respective structural members so that the closed end is in a raised position relative to the respective structural members; and a cladding material attached to the raised closed end of the cladding support members and to the raised second surface of the cladding support elements.

* * * * *